US008748763B2

(12) United States Patent
Wechtenhiser

(10) Patent No.: US 8,748,763 B2
(45) Date of Patent: Jun. 10, 2014

(54) SWITCH ASSEMBLY

(75) Inventor: Bert W. Wechtenhiser, Jacksonville, FL (US)

(73) Assignee: Dwyer Precision Products, Inc., Jacksonvill, FL (US)

( * ) Notice: Subject to any disclaimer, the term of this patent is extended or adjusted under 35 U.S.C. 154(b) by 159 days.

(21) Appl. No.: 13/200,290

(22) Filed: Sep. 21, 2011

(65) Prior Publication Data

US 2013/0068604 A1 Mar. 21, 2013

(51) Int. Cl.
*H01H 1/58* (2006.01)
*H01H 35/24* (2006.01)

(52) U.S. Cl.
USPC ..... 200/81 H; 200/51 R; 200/505

(58) Field of Classification Search
USPC ..... 200/505, 5 R
See application file for complete search history.

(56) References Cited

U.S. PATENT DOCUMENTS 2,875,291 A 2/1959 Armstront et al.
3,104,293 A 9/1963 Rendler
4,022,690 A * 5/1977 Smith ..... 210/167.1
4,668,847 A 5/1987 Greene
4,754,107 A 6/1988 Tracey
5,113,048 A 5/1992 Lafferty
5,736,702 A * 4/1998 Roberts et al. ..... 200/81 H
5,999,100 A 12/1999 Wright et al.
7,267,374 B2 * 9/2007 Nielson ..... 285/353
7,449,646 B1 11/2008 Wechtenhiser

* cited by examiner

*Primary Examiner* — Renee Luebke
*Assistant Examiner* — Ahmed Saeed
(74) *Attorney, Agent, or Firm* — Paul Bogdon

(57) ABSTRACT

In a pneumatically actuated switching device having a pneumatic actuator for delivering pressurized air to a switch assembly for generating an electrical signal, the switch assembly comprises a switch housing having a conductive element for opening and closing a circuit; and a pneumatic hose connection member removably mounted to the housing for connecting a pneumatic hose to the housing for delivering the pressurized air for generating the electrical signal. The pneumatic hose connection member has an enlarged portion flushed with the housing, a first extended portion having a threaded section for attachment to the housing, and a second extended portion having a plurality of anchor thugs for securing the pneumatic hose. The housing and pneumatic hose connection member have a plurality of gripping elements for facilitating the insertion and removal of the pneumatic hose connection member relative to the housing and the attachment and detachment of the pneumatic hose.

8 Claims, 4 Drawing Sheets

SWITCH ASSEMBLY

BACKGROUND OF THE INVENTION

1. Field of the Invention

The invention relates to a pneumatically actuated switching device for a patient call system. More specifically, the invention relates to a switch assembly comprising a pneumatic hose connection member for connecting the pneumatic hose to the housing of the switch assembly for operation of the switch assembly of the pneumatically actuated switching device.

2. Description of the Prior Art

Hospitals and other patient-care institutions frequently provide patient call systems wherein a patient may activate a signal to a central station, such as a nurse's station, to summon assistance. The use of conventional electrical switches to generate the signal in such environments is undesirable given the potentially combustible levels of oxygen that may be present near the patient area.

An alternative to conventional electrical switches involves the use of a pneumatically actuated switching device which utilizes a pulse of pressurized air to actuate a signal circuit and which avoids the safety concerns associated with the conventional electrical switch. Such pneumatically actuated switching devices are particularly beneficial where combustion concerns are present, such as, for example, in oxygen rich environments since the construction of the pneumatically actuated switching device limits the possibility of electrical arcing which is a problem associated with conventional electrical switches.

U.S. Pat. No. 3,823,285 to Dwyer illustrates an example of a pneumatically actuated switching device having a deformable pneumatic actuated bulb for a patient actuated nurse call system. The deformable pneumatic actuated bulb provides a source of pressurized air to operate a switching circuit which generates an electrical signal. This system is well suited for use in environments where it is undesirable to use a conventional electrical switch for the reasons discussed in the preceding paragraphs. The pneumatically actuated switching device comprises an electrically conductive sleeve having a bore and a conductive ball in the bore which is movable in response to pneumatic pressure. The other end of the bore is in communication with a pneumatic hose or tube which is connected to a source of pneumatic pressure, such as the deformable pneumatic actuated bulb. Two conductors are adapted to be connected to two sides of an electrical circuit. The first conductor is in electrical communication with the sleeve and the second conductor is mounted in an opening in the sleeve which extends into the bore. The ball is movable between a circuit open position out of electrical communication with the second conductor and a circuit closed position in electrical communication with the second conductor and the sleeve. A cam surface extends into the bore and into the path of the ball and cams the ball into electrical communication with the second conductor and the sleeve in the circuit closed position. The sleeve normally is oriented generally vertically, although the device operates satisfactorily when the sleeve is oriented horizontally in that the ball moves in the bore with very little, if any, friction.

U.S. Pat. No. 5,155,309 to Dwyer illustrates a further example of a pneumatically actuated switching device which comprises a pneumatic bulb having an annular ring configuration with a convexly shaped actuator dome resembling a doughnut to provide a distinctive identification to the bulb for distinction from other pneumatic bulbs that may be utilized for different purposes in a patient area. A base plate includes protruding truncated conical members relied upon to maintain the doughnut shaped actuator at a fixed location on a patient's mattress so that the patient can find the deformable pneumatic bulb to summon assistance.

U.S. Pat. No. 5,736,702 to Roberts, et al. discloses a still further example of a pneumatically actuated switching device. A housing connection provides for optional assembly orientations, i.e. an in-line assembly configuration for the switch housing and a right angle configuration for the switch housing relative to a jack for electrical connection with a receptacle of a patient call system. The optional assembly orientations are brought about via a connector which is partially enclosed within a cavity formed in an end of the housing. The connector and the switch housing of this pneumatically actuated switching device is generally glued together once the pins are in the appropriate openings for forming a desired angular orientation of the connector relative to the housing.

These above pneumatically actuated switching devices in general have a pneumatic hose or tube connected at its one end to the switch assembly and connected at its other end to the deformable pneumatic bulb for delivering pressurized or compressed air to the switch assembly for activation of the switch assembly which sends an electrical signal to the patient call system. In general, the pneumatic hose of these prior art devices are attached to the housing of the switch assembly via a connector member and mechanical devices, such as, for example, pins or via a connector member which is shrink or pressed fitted to the housing with the pneumatic hose being wedged into the connector member. The connector member in some instances may become loosened and/or may become disconnected from the housing of the switch device, resulting in the loss of pressurized air for operation of the switch assembly.

There is therefore a need in the art to provide an improved design for connecting a connection member for attaching a pneumatic hose to a housing of a switch assembly in a pneumatically actuated switching device.

There is a further need in the art to provide a connection member for attaching a pneumatic hose to a housing of a switch assembly in a pneumatically actuated switching device which is easy to install and/or remove and which is not easily dislodged from the housing.

SUMMARY OF THE INVENTION

The invention has met these needs. The present invention provides a switch assembly for use in a pneumatically actuated switching device, which has a pneumatic actuator for delivering pressurized air to the switch assembly for generating an electrical signal when the pneumatic actuator is operated. The switch assembly comprises a housing having an air chamber, an electrical connection extending into the air chamber and having an electrical conductive element for opening and closing a circuit, an air conduit in communication with the air chamber; and a pneumatic hose connection member removably mounted in the housing for connecting a pneumatic hose to the housing and in communication with the air conduit of the housing for delivering pressurized air into the air chamber of the housing for operation of the electrical connection for generating the electrical signal. The pneumatic hose connection member is simple in construction for easy mounting and removable thereof and/or the pneumatic hose relative to the housing. In a well-known manner, the pneumatic actuator creates pressurized air which operates the electrical conductive element in the switch assembly, which, in turn, generates the electrical signal.

The pneumatic hose connection member comprises an enlarged portion structured to be flushed with the housing when assembled to the housing of the switch assembly, a first extended portion having a threaded section for attachment of the pneumatic hose connection member to the housing, and a second extended portion having an elongated section for receiving and connecting the pneumatic hose to the housing.

The second extended portion of the pneumatic hose connection member comprises an outer surface having a plurality of anchor thugs for attaching and securing the pneumatic hose to the pneumatic hose connection member.

The housing and the pneumatic hose connection member each comprises a plurality of gripping elements for facilitating the insertion and/or removal of the pneumatic hose connection member relative to the housing of the switch assembly and/or for facilitating the attachment and/or detachment of the pneumatic hose to and from the pneumatic hose connection member.

It is therefore an object of the present invention to provide a pneumatic hose connection member that is simple in construction for easy insertion into and/or removal from a housing of a switch assembly and for easy attachment of a pneumatic hose to a housing of the switch assembly.

These and other objects of the invention will be better appreciated and understood when read in light of the accompanying drawings.

DETAILED DESCRIPTION OF THE INVENTION

The switch assembly of the invention may be used in a pneumatically actuated switching device, which device, in turn, can be used in a variety of systems and environments in which it is desirable to switch an electrical circuit on or off by remote means. The pneumatically actuated switching device is particularly well suited for use with conventional nurse call signal systems and since in this context the features of the invention are highlighted, the invention is described herein in combination with such a system. However, it should be understood that the invention is not limited to such use.

The switch assembly 10 of FIGS. 1, 2 and 3 may be used to position an electrical connection (not shown) at a right angle, more about which is discussed herein below or may be used to position an electrical connection in an in-line configuration such as that illustrated in FIG. 7. An example of a pneumatically actuated switching device in which the switch assembly 10 of the present invention may be used is disclosed in the above discussed U.S. Pat. No. 5,155,309 which is incorporated herein by reference in its entirety. The pneumatically actuated switching device of U.S. Pat. No. 5,155,309 illustrates a right angle configuration of the electrical connection extending from the switch housing relative to an air conduit or pneumatic hose.

A further example of a pneumatically actuated switching device in which the switch assembly 10 of the present invention may be used is disclosed in the above discussed U.S. Pat. No. 3,823,285, which is also incorporated herein by reference in its entirety. As taught in U.S. Pat. No. 3,823,285, the pneumatically actuated switching device comprises five basic components: a sleeve; a ball; housing; an electrical plug; and a pneumatic actuating means comprising a tube or pneumatic hose and a deformable bulb. According to the teachings of U.S. Pat. No. 3,823,285, pressurized air, via operation of the deformable bulb is delivered through the pneumatic hose and into housing which forces the ball against a hemispherical head and in a circuit closed position as shown in FIG. 2 of U.S. Pat. No. 3,823,285. In the electrical circuit closed position, the ball is in electrical communication with a first conductor via the head and with a second conductor via a pin and a sleeve. This electrical circuit closed position sends an electrical signal to the nurse's station.

Figure 3:
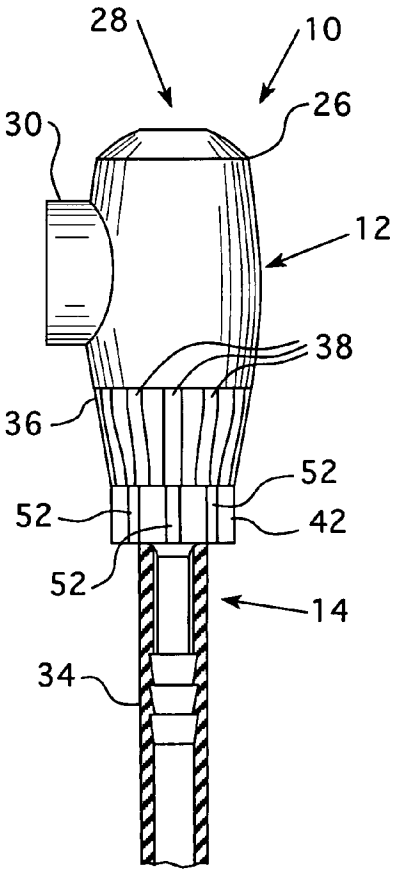
FIG. 3 is a right side elevation view of the switch assembly of FIG. 1 with the pneumatic hose in cross section and broken away.
Figure 2:
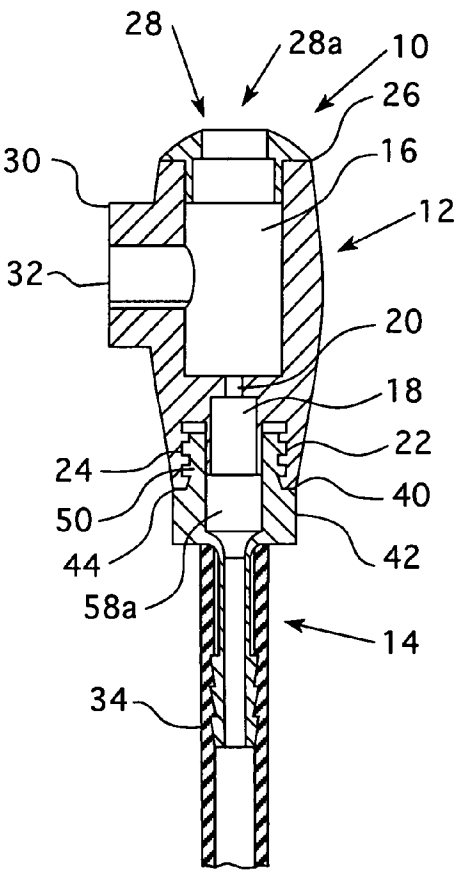
FIG. 2 is a cross-section view of the switch assembly of the invention taken along lines 2-2 of FIG. 1.
Figure 1:
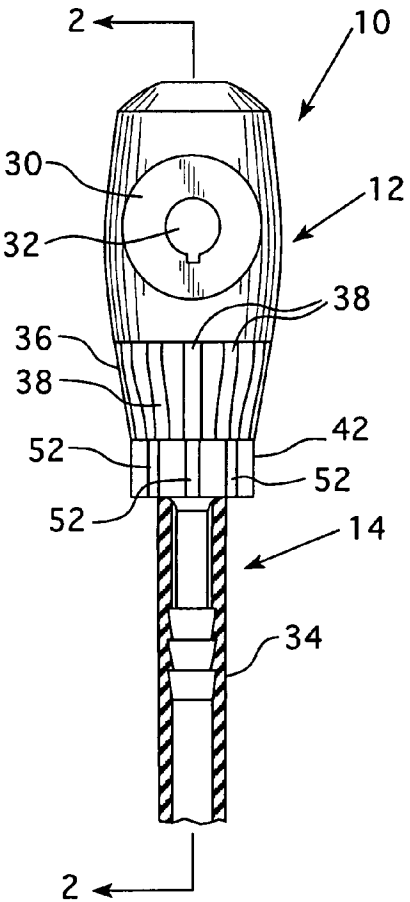
FIG. 1 is a front elevation view of a switch assembly of the invention with a pneumatic hose in cross section and broken away.

Referring particularly to FIGS. 1, 2 and 3 of the present invention, the switch assembly 10, for clarity purposes, is shown without the inner components which operate to close and open an electrical circuit such as that disclosed in the above U.S. Pat. Nos. 3,823,285 and 5,155,309. However, it is to be understood that in order for the switch assembly 10 of the invention to function in its intended fashion it would be necessary to have these several components in the switch assembly 10 for closing and opening an electrical circuit similar to that disclosed in the aforesaid U.S. Pat. Nos. 3,823,285 and 5,155,309.

Still referring specifically to FIGS. 1, 2, and 3, switch assembly 10 comprises a housing 12 and a pneumatic hose connection member 14. Housing 12 has, in general, a cylindrical configuration and is preferably made of a one-piece construction which may be produced via an extrusion process. As shown best in FIG. 2, housing 12 includes an air chamber 16 and an air conduit 18 in communication with air chamber 16 via an air passage 20. Adjacent air conduit 18 of housing 12 is a first bore 22 with an inner wall that contains a threaded section 24 which receives the pneumatic hose connection member 14, more about which is discussed herein below.

Still referring to FIG. 2, the upper section of housing 12 includes a second bore 26 which receives a cap assembly 28. Cap assembly 28 may be a press-fit or a snap-in fit in bore 26. If switch assembly 10 is used for positioning an electrical connection at a right angle in housing 12 similar to that disclosed in the aforesaid U.S. Pat. Nos. 3,823,285 and 5,155,309, then cap assembly 28 contains an air filter for allowing low pressure air to flow freely into and out of air chamber 16 while preventing dirt and moisture from entering bore 26 and air chamber 16 which could interfere with the proper operation of the pneumatically actuated switching device. This air filter can be made from any suitable material such as metal, refractory or plastic. In some embodiments, cap assembly 28 may be of the same material as housing 12 and the pneumatic hose connection member 14, which material may be plastic.

Still referring to FIG. 2, housing 12 further includes an extended section 30 which includes a bore or passage 32 for receiving an electrical connection (not shown) in a manner similar to that disclosed in the above U.S. Pat. Nos. 3,823,285 and 5,155,309, which, as discussed in the preceding paragraph, would position the electrical connection at a right angle configuration relative to pneumatic hose 34. Passage 32 is in communication with air chamber 16 for receiving the pressurized air from the pneumatic hose 34 which is shown in cross section in FIG. 2.

FIGS. 1 and 3 illustrate the external features of housing 12 and pneumatic hose connection member 14 and their connection together. As shown, housing 12 has a lower tapered area with an outer surface 36 which includes a plurality of gripping elements 38 encircling the outer surface 36 of lower tapered area of housing 12. Gripping elements 38 may be used to facilitate the insertion and/or removal of pneumatic hose connection member 14 relative to housing 12 and/or the attachment and/or detachment of pneumatic hose 34 from connection member 14.

As shown best in FIG. 2, when pneumatic hose connection member 14 is assembled in housing 12, connection member 14 abuts against housing 12 with a surface 40 of connection member 14 being flushed with a surface 44 of housing 12. This structure provides a quick connection of connection member 14 to housing 12 with connection member 14 locking in place within housing 12, more about which is discussed herein below.

Details of the pneumatic hose connection member 14 will now be given with reference to FIGS. 4, 5 and 6. Pneumatic hose connection member 14 comprises an enlarged portion 42, a first extended portion 46, and a second extended portion 48. Enlarged portion 42 is structured to be flushed with housing 12 when assembled together as discussed in the preceding paragraph. First extended portion 46 has a diameter that is less than that of enlarged portion 42 and includes a threaded section 50 which engages the threaded section 24 of the inner wall of bore 22 of housing 12 for attachment of the connection member 14 to housing 12. Second extended portion 48 is elongated and has a diameter less than that of first extended portion 46 for receiving the pneumatic hose 34. Additionally, the outer surface of enlarged portion 42 of pneumatic hose connection member 14 includes a plurality of gripping elements 52 best shown in FIGS. 4 and 5 for facilitating the attachment and/or detachment of connection member 14 relative to housing 12 and/or for the attachment and/or detachment of pneumatic hose 34 relative to second extended portion 48 of connection member 14. As discussed in the preceding paragraph, the structure of connection member 14 and housing 12 provides for a quick connection of connection member 14 to housing 12, and conversely, a quick disconnection of connection member 14 from housing 12 via the threaded section 50 on the first extended portion 46 and the gripping elements 52 on the outer surface of the enlarged portion 42 of connection member 14.

Figure 5:
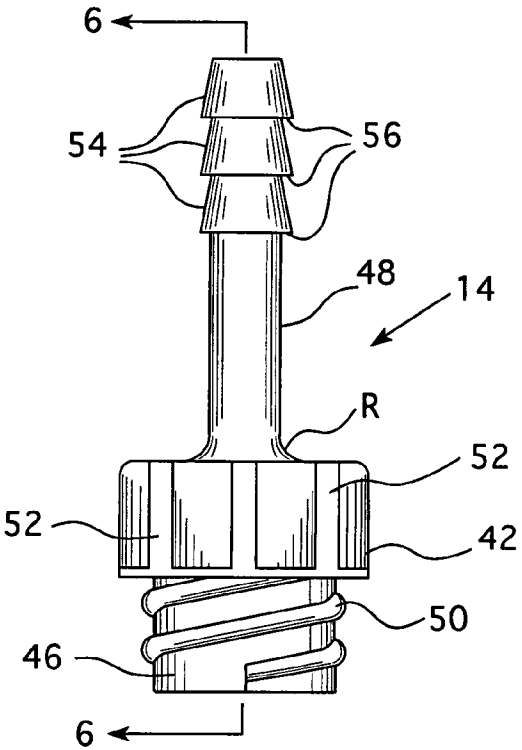
FIG. 5 is a front elevation view of the pneumatic hose connection member of FIG. 4.
Figure 4:
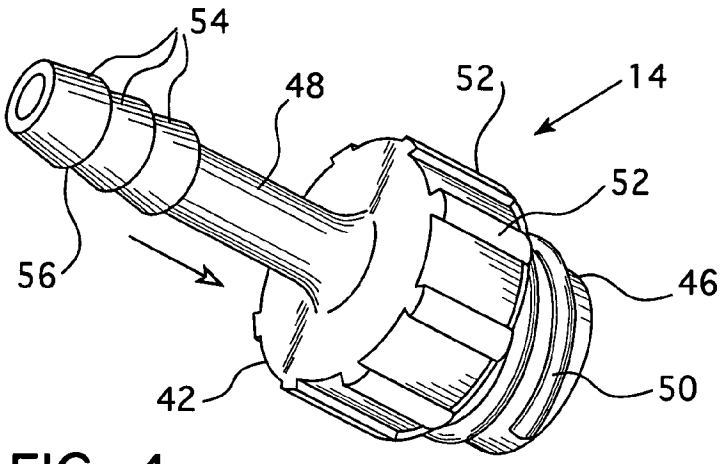
FIG. 4 is an enlarged perspective view of a pneumatic hose connection member of the invention prior to its mounting into the housing of the switch assembly of FIG. 1.
Figure 6:
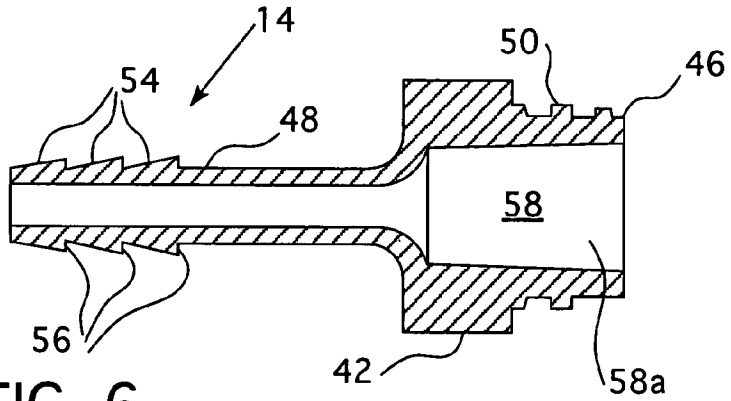
FIG. 6 is a cross-sectional view of the pneumatic hose connection member taken along lines 6-6 of FIG. 5 and rotated 90 degrees to the left.

Still referring to FIGS. 4, 5 and 6, the second extended portion 48 further includes a plurality of anchor thugs 54 for attaching pneumatic hose 34 to connection member 14. As shown in these figures, anchor thugs 54 are constructed in a step-like fashion and assist in preventing the pneumatic hose 34 from dislodging from connection member 14. That is, the inner wall of pneumatic hose 34 will engulf around the contour of anchor thugs 54 such that when the pneumatic hose 34 is pushed upward onto second extended portion 48 the perimeter 56 of anchor thugs 54 acts as a friction element thereby preventing pneumatic hose 34 from moving away from the enlarged portion 42 of pneumatic hose connection member 14. An air passageway 58 extends throughout the entire length of pneumatic hose connection member 14 as best shown in FIG. 6 and has an enlarged portion **58*a* that is in direct communication with air conduit 18 of housing 12 for delivering the pressurized air into housing 12 when pneumatic hose 34 is attached to the second extended portion 48 of connection member 14 as best shown in FIG. 2**.

In some embodiments, the radius R of the curved area shown in FIG. 5 may be about 0.062 inches and the diameter of perimeter 56 of anchor thugs 54 may be about 0.198 inches. These dimensions may be significant in that when the second extended portion 48 of connection member 14 is pressed into pneumatic hose 34, the R of the curved area and the perimeter 56 of anchor thugs 4 provide a substantially high anchorage strength for securing pneumatic hose 34 to second extended portion 48.

The pitch of threaded section 24 of housing 12 and threaded section 50 of connection member 14 in general correspond with each other so that the pneumatic hose connection member 14 can easily be screwed into and out of housing 12 in a well-known fashion.

Figure 7:
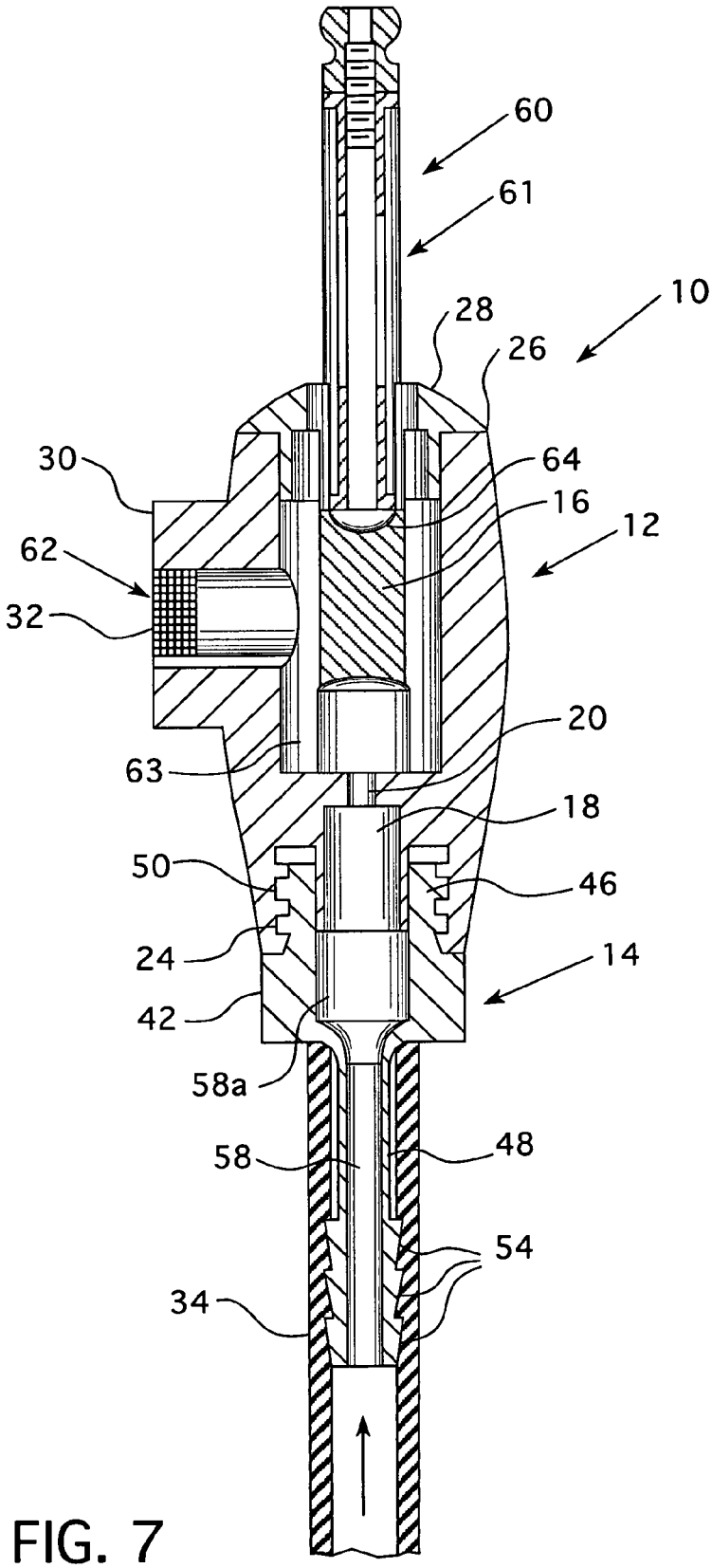
FIG. 7 is an enlarged partly cross section view of the switch assembly of the invention wherein an electrical connection is in-line with the pneumatic hose connection member of the invention.

FIG. 7 illustrates an in-line configuration for the switch assembly 10 of FIGS. 1 through 6. In this instance, an electrical connection 60 comprising an electrical plug 61 and a cylinder 63 is in-line with pneumatic hose connection member 14 and electrical plug 61 extends through cap assembly 28. In this configuration, passage 32 of extended portion 30 contains an air filter assembly 62, details of which are discussed herein above and well known to those skilled in the art. Air chamber 16 contains cylinder 63 which is forced upward by the pressurized air for contact with head 64 of electrical plug 61 of electrical connection 60 for operation thereof according to the teachings of the aforesaid U.S. Pat. Nos. 3,823,285 and 5,155,309.

As discussed herein above with particular references to FIGS. 1-3, switch assembly 10 may be used to accommodate a right angle configuration of an electrical connection relative to the pneumatic hose 34, or switch assembly 10 may be used to accommodate an in-line configuration of an electrical connection relative to the pneumatic hose 34 as illustrated in FIG. 7. In some embodiments, housing 12 and pneumatic hose connection member 14 may be made of thermoplastic materials and/or may be made through an extrusion process.

Figure 8:
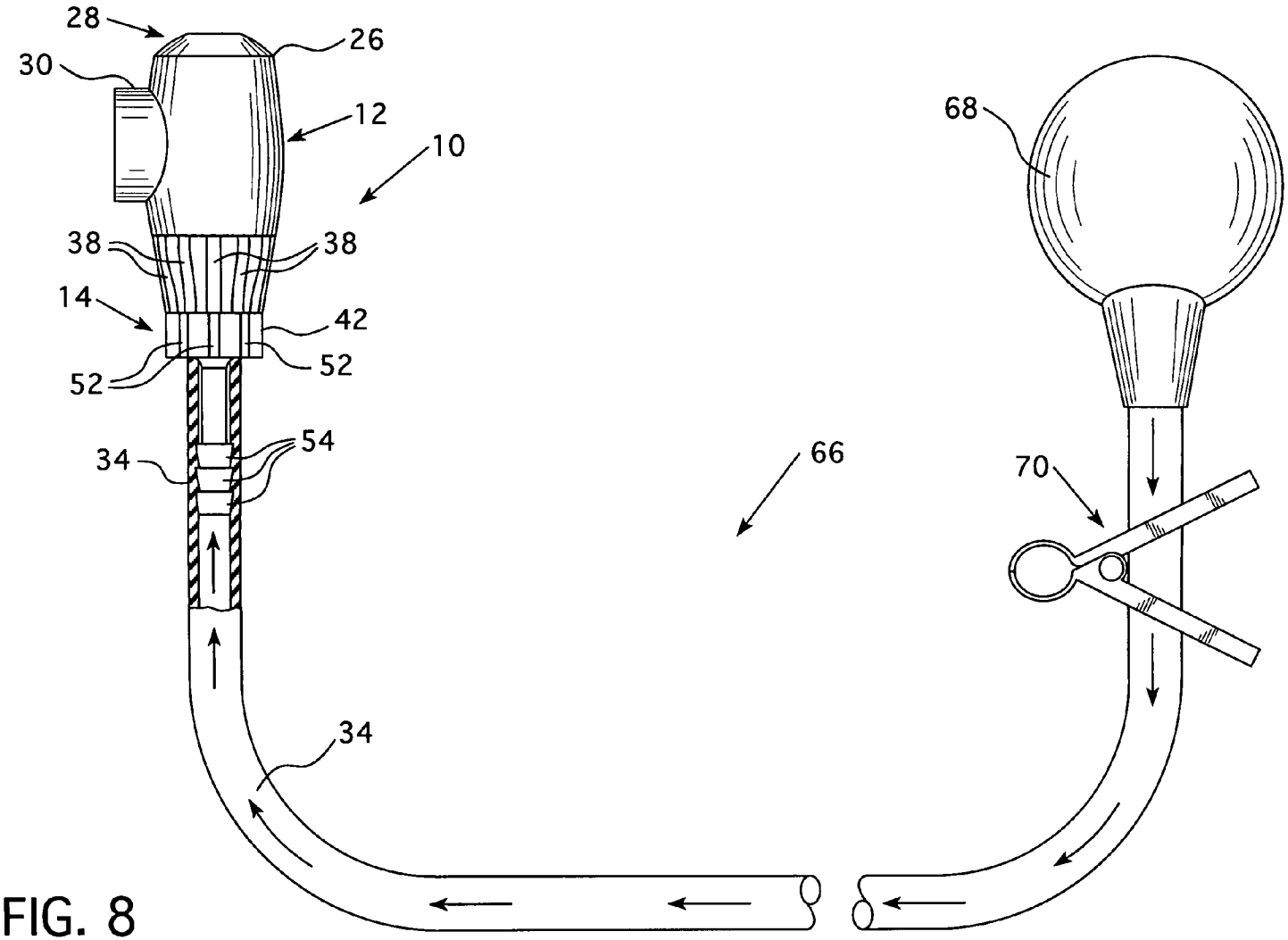
FIG. 8 is an illustration of a pneumatically actuated switching device including the switch assembly of the invention and a pneumatic hose partially in cross section.

FIG. 8 exemplifies the manner in which switch assembly 10 may be used in a pneumatically actuated switching device 66, which further includes a pneumatic actuator 68, a pneumatic hose or tubing 34, and a clip device 70 for attaching pneumatic hose 34 to an object, such as, for example, a bed sheet of a patient's bed. In a well-known manner, pneumatic actuator 68 is depressed and a flow of air indicated by the arrows in FIG. 8 is directed through pneumatic hose 34 and into the switch assembly 10 to generate an electrical signal for assistance in a nurse's station. The switch assembly 10 of the invention may be used with, but is not limited to, devices, such as, for example monitors, pagers and/or transmitters used in patient nurse call systems. Such devices are available from Dwyer Precision Products, Inc., Florida, under the trademarks Prescall®, Padcall®, Unicall®, Breathcall®, and Headcall®.

While the present invention has been described in connection with the embodiments of the various figures, it is to be understood that other similar embodiments may be used or modifications and additions may be made to the described embodiments for performing the same function of the present invention without deviating there from. Therefore, the present invention should not be limited to any single embodiment, but rather construed in breadth and scope in accordance with the recitation of the appended claims.

What is claimed is:

1. A pneumatically actuated switching assembly for connection with a pneumatic hose, pneumatic actuator, and an electrical connection for generating an electrical signal when the pneumatic actuator is operated, comprising:

an elongated housing means having a first end section and an opposite second end section, and defining at least one air chamber for receiving a movable electrical connector responsive to pressurized air, and further defining an air conduit communicating with the air chamber;

a hose connection member sized and shaped to be selectively, removably secured to said housing means within said second end section, and defining an internal air passageway extending throughout and communicating with said air conduit;

said hose connection member including an elongated extension with said internal air passageway extending therethrough shaped and sized for snugly receiving the pneumatic hose connected with the pneumatic actuator, with the internal air passageway of the pneumatic hose corresponding with said air conduit; and;

a cap assembly means secured to said first end section of said housing means and defining a central opening therethrough communicating with said air chamber for receiving an electrical plug portion of the electrical connector; and wherein a moveable cylinder of the electrical connector is slidably received in said air chamber and is responsive to pressurized air to move into engagement with the plug portion and to disengage from the plug portion upon removal of pressurized air.

2. The pneumatically actuated switching assembly of claim 1 wherein said second end section of said housing means includes an internal first connector and said hose connection member includes an external second connector shaped and sized to mate with said first connector of said housing means with said first and second connector selectively attachable and detachable from one another.

3. The pneumatically actuated switching assembly of claim 2 wherein said first internal connector and external second connector are threaded and correspond and mate with each other.

4. A pneumatically actuated switching assembly for connection with a pneumatic hose, pneumatic actuator, and an electrical connection for generating an electrical signal when the pneumatic actuator is operated, comprising:

an elongated housing means having a first end section and an opposite second end section, and defining at least one air chamber for receiving a movable electrical connector responsive to pressurized air, and further defining an air conduit communicating with the air chamber;

a hose connection member sized and shaped to be selectively, removably secured to said housing means within said second end section, and defining an internal air passageway extending throughout and communicating with said air conduit;

said hose connection member including an elongated extension with said internal air passageway extending therethrough shaped and sized for snugly receiving the pneumatic hose connected with the pneumatic actuator, with the internal air passageway of the pneumatic hose corresponding with said air conduit; and;

a cap assembly means secured to said first end section of said housing means for selectively closing and opening said first end section; and wherein said air chamber extends longitudinally of said housing means; and including a transversely extending section defining a bore communicating with said air chamber for receiving a plug portion of the electrical connector; and wherein a movable cylinder of the electrical connector is slidably received in said air chamber and is responsive to pressurized air to move into engagement with the plug portion and to disengage from the plug portion upon removal of pressurized air.

5. The pneumatically actuated switching assembly of claim 1 wherein said elongated extension of said hose connection member has an outer surface having a plurality of anchor thugs for securing the pneumatic house to the hose connection member.

6. The pneumatically actuated switch assembly of claim 1 wherein said housing means and said hose connection member are formed of thermoplastic materials.

7. The pneumatically actuated switch assembly of claim 1 where said housing means and said hose connector member are extrusion components.

8. The pneumatically actuated switch assembly of claim 1 wherein said housing means and said hose connection member each include a plurality of gripping elements for facilitating the insertion and removal of said hose connection member to said housing means of the switch assembly.

* * * * *